US008976989B2

(12) United States Patent
Barthel et al.

(10) Patent No.: US 8,976,989 B2
(45) Date of Patent: Mar. 10, 2015

(54) METHOD FOR OPERATING A HEARING APPARATUS

(71) Applicant: Siemens Medical Instruments Pte. Ltd., Singapore (SG)

(72) Inventors: Roland Barthel, Forchheim (DE); Clemens Otte, Munich (DE); Uwe Rass, Nuermberg (DE); Florian Steinke, Munich (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 0 days.

(21) Appl. No.: 13/864,443

(22) Filed: Apr. 17, 2013

(65) Prior Publication Data

US 2013/0272552 A1 Oct. 17, 2013

(30) Foreign Application Priority Data

Apr. 17, 2012 (DE) ..... 10 2012 206 299

(51) Int. Cl.
*H04R 25/00* (2006.01)

(52) U.S. Cl.
CPC ..... *H04R 25/50* (2013.01); *H04R 25/505* (2013.01); *H04R 2225/41* (2013.01); *H04R 2225/43* (2013.01)
USPC ..... 381/312; 381/314

(58) Field of Classification Search
CPC ..... H04R 25/50
USPC ..... 381/312, 314
See application file for complete search history.

(56) References Cited

U.S. PATENT DOCUMENTS

| | | | | |
|---|---|---|---|---|
| 7,091,409 | B2 | 8/2006 | Li et al. | |
| 2010/0027820 | A1 | 2/2010 | Kates | |
| 2010/0202637 | A1 * | 8/2010 | Cornelisse et al. | 381/314 |
| 2010/0232633 | A1 * | 9/2010 | Nielsen | 381/317 |

FOREIGN PATENT DOCUMENTS

WO 2004075093 A2 9/2004

OTHER PUBLICATIONS

"Moving average"; From Wikipedia, the free encyclopedia http://en.wikipedia.org/wiki/Moving_average Jan. 12, 2012; 2012.
"Trimmed mean / Truncated mean" From Wikipedia, the free encyclopedia http://en.wikipedia.org/wiki/Truncated_mean Nov. 28, 2011; 2011.

(Continued)

*Primary Examiner* — Brian Ensey
*Assistant Examiner* — Norman Yu
(74) *Attorney, Agent, or Firm* — Laurence A. Greenberg; Werner H. Stemer; Ralph E. Locher

(57) ABSTRACT

A method operates a hearing apparatus in which an operating parameter of the hearing apparatus is determined and smoothed by a filter. The smoothing includes, for each input value, to classify the input value in accordance with its association with a plurality of predetermined classes and increase a counter assigned to the respective class which is associated with the input value. The counter with the greatest counter value is determined and the operating parameter value assigned to the counter with the greatest counter value is output as an output variable of the filter.

5 Claims, 2 Drawing Sheets

(56) References Cited

OTHER PUBLICATIONS

"Median filter", From Wikipedia, the free encyclopedia http://en.wikipedia.org/wiki/Median_filter Jul. 6, 2011; 2011.

Barbedo et al.: "A Robust and Computationally Efficient Speech/Music Discriminator", J. Audio Eng. Soc., vol. 54, No. 7/8, Jul./Aug. 2006, pp. 571-588, XP040377899.

* cited by examiner

METHOD FOR OPERATING A HEARING APPARATUS

CROSS-REFERENCE TO RELATED APPLICATION

This application claims the priority, under 35 U.S.C. §119, of German application DE 10 2012 206 299.8, filed Apr. 17, 2012; the prior application is herewith incorporated by reference in its entirety.

BACKGROUND OF THE INVENTION

Field of the Invention

The invention relates to a method for operating a hearing apparatus, in which an operating parameter of the hearing apparatus is determined and smoothed by a filter. The invention further relates to a hearing apparatus having a signal processing apparatus, wherein at least one operating parameter of the signal processing apparatus can be adjusted and smoothed by a filter.

The term hearing apparatus is understood here to mean any auditory stimulus-producing device which can be worn in or on the ear, in particular a hearing device, a headset, earphones or suchlike.

Hearing devices are wearable hearing apparatuses which are used to provide hearing assistance to the hard-of-hearing. In order to accommodate the numerous individual requirements, various designs of hearing devices are available such as behind-the-ear (BTE) hearing devices, hearing device with external earpiece (RIC: receiver in the canal) and in-the-ear (ITE) hearing devices, for example also concha hearing devices or completely-in-the-canal (ITE, CIC) hearing devices. The hearing devices listed as examples are worn on the outer ear or in the auditory canal. Bone conduction hearing aids, implantable or vibrotactile hearing aids are also available on the market. With these devices the damaged hearing is stimulated either mechanically or electrically.

The key components of hearing devices are principally an input transducer, an amplifier and an output transducer. The input transducer is normally a sound receiver e.g. a microphone and/or an electromagnetic receiver, e.g. an induction coil. The output transducer is most frequently realized as an electroacoustic transducer, e.g. a miniature loudspeaker, or as an electromechanical transducer, e.g. a bone conduction receiver. The amplifier is usually integrated into a signal processing unit. This basic configuration is illustrated in FIG. 1 using the example of a behind-the-ear hearing device. One or more microphones 2 for picking up ambient sound are incorporated into a hearing device housing 1 to be worn behind the ear. A signal processing unit 3 which is also integrated into the hearing device housing 1 processes and amplifies the microphone signals. The output signal from the signal processing unit 3 is transmitted to a loudspeaker or receiver 4, which outputs an acoustic signal. The sound may be transmitted to the device wearer's eardrum by way of an acoustic tube which is fixed in the auditory canal by an ear-mold. Power for the hearing device and in particular for the signal processing unit 3 is supplied by a battery 5 which is also integrated in the hearing device housing 1.

The signal processing unit contains operating parameters, which are dependent on the microphone signals. For instance, the strength of a noise filtering is varied as a function of noise intensity or an additional directional microphone with a given strength is activated as a function of an acoustic environment.

These operating parameters therefore vary temporally with the acoustic environment. In order to prevent frequent sudden changes in parameter values, it is usual to smooth the temporal curve of the parameter values by a suitable filter.

One example of this is a smoothing average value filter, such as the exponentially weighted smoothing average value. In order to achieve a smoothing with such a filter, the data to be smoothed relating to the entire window width in which the smoothing is to take place, must be provided in the storage device of the signal processing unit. With conventional operating conditions, for instance a sampling rate of 24 kHz and a window width of 3 s, significant data quantities accumulate which, on account of the limited storage capacity of conventional signal processing apparatuses, may rapidly lead to capacity problems.

U.S. patent publication No. 2010/0232633 A1 discloses a method for recording operating parameters of a hearing device, in which input data is classified in accordance with its association with value ranges. A digit assigned to the respective value range is incremented for each input value, so that a histogram is obtained which reproduces the distribution of the input values.

SUMMARY OF THE INVENTION

It is accordingly an object of the invention to provide a method for operating a hearing apparatus and a hearing apparatus which overcome the above-mentioned disadvantages of the prior art methods and devices of this general type, which enable a smoothing of temporally varying operating parameter values of a hearing apparatus with as little storage space requirements as possible.

With an inventive method, the input value is classified for each input value, in other words each unsmoothed value, in accordance with its association with a plurality of predetermined classes and a counter assigned to the respective class, which belongs to the input value, is increased. In the simplest case, the counter value of the counter can in this way be incremented by one, other increments which vary if necessary from step to step can however also be used. The counter with the greatest counter value is then determined and an operating parameter value assigned to the counter with the greatest counter value is output as an output variable of the filter.

Such a smoothing method manages with significantly less storage compared with algorithms known from the prior art. Instead of having to store the input data relating to the entire window width, only the storage space for the counter assigned to the respective classes is required so that the method is in particular suited to use under the relatively limited conditions of hearing apparatuses.

In a first variant of the method, only the operating parameter value assigned to the counter with the greatest counter value is then output as an output variable if the counter exceeds a predetermined threshold value. Alternatively, the operating parameter value output last is retained as an output variable. The choice of threshold value essentially determines here the window width of the smoothing algorithm.

It is expedient in this case, when exceeding the threshold value, by one of the counters after outputting the output variable, to set all counters to zero so that the smoothing effect is retained and the storage space is limited.

In the embodiment illustrated up to now, the method is in particular suited to smoothing operating parameters of the hearing apparatus, which already exist in a discretized form. This may be for instance the evaluation of the acoustic surroundings of the hearing apparatus according to a number of discrete classes (conversational situation, background music and suchlike).

The method is however also suited to handling non-discrete, real-valued operating parameters. In this case, the classes are preferably represented by cohesive intervals across predetermined, non-discrete value ranges, in order to achieve a discretization in the first step of the method which enables a particularly storage-efficient processing.

It is further expedient here to scale all counter values by a predetermined factor $\lambda$ with $0 \leq \lambda \leq 1$ prior to increasing the counter value. Such a scaling limits the growth of the counter values and thus indirectly determines the window width of the smoothing algorithm. The scaling further influences the extent to which values present in the past determine the current output variable of the filter so that the characteristics of the filter can be adjusted particularly easily by choosing $\lambda$.

Instead, as in the initially described variant, of simply incrementing the counter by one for each class which can be assigned an input value, a more complex method of counting is preferably selected here. All counter values are herewith increased by an amount which is dependent on a distance of the input value from a center point of the interval corresponding to the respective class.

In other words, an input value in this variant of the method not only influences the counter of the class to which it directly belongs, but also the counter of adjacent classes. This results in an additional smoothing and improves the robustness of the algorithm.

It is particularly expedient here to increase the counter value vj of a class j of the classes, which is assigned an interval with the center point bj, by $(1-\lambda)\max(0,1-(|yi-bj|)/\sigma))$ for each input value yi of the operating parameter, wherein $\sigma$ represents a predetermined influence radius.

Classes, the interval center point of which are further away from the input value than the amount of $\sigma$, are therefore not influenced so that the smoothing properties of the filter can be set by choosing $\sigma$.

Overall, an algorithm is created, which, with a constantly low storage requirement, can smooth real-valued data across any window width both in a discretized and also non-discrete manner, and is in this way robust compared with outliers and transient events.

The invention further relates to a hearing apparatus of the type cited in the introduction, a signal processing apparatus of which has a filter and is designed, in order to smooth the operating parameter for each input value, to classify the input value in accordance with its association with a plurality of predetermined classes and to increase a counter assigned to the respective class, which belongs to the input value, to determine the counter with the greatest counter value and to output an operating parameter value assigned to the counter with the greatest counter value as an output variable of the filter. As already explained with the aid of the inventive method, a robust and storage-efficient smoothing of the operating parameters of the hearing apparatus can herewith be achieved.

Other features which are considered as characteristic for the invention are set forth in the appended claims.

Although the invention is illustrated and described herein as embodied in a method for operating a hearing apparatus and a hearing apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

In order to achieve an optimal output for the user, hearing apparatuses must be adjusted to the respective acoustic environment in which they are used. To this end, different operating parameters of the hearing apparatus can be adjusted as a function of the ambient conditions. For instance, the strength of noise filtering can be changed, additional directional microphones with different sensitivity can be switched on and suchlike.

The operating parameters are in this way determined as a function of an acoustic input signal of the hearing apparatus. Depending on the type of acoustic event, this may result in strong, sudden fluctuations in the operating parameters, which negatively affect the hearing comfort. It is necessary for this reason to smooth the temporal curve of these operating parameters.

Smoothing methods known from the prior art, such as for instance the exponentially weighted smoothing averaging, nevertheless require large quantities of storage space, since the complete input data to be smoothed has to be provided across the entire window width of the smoothing algorithm in the storage device, which can rapidly fully load the limited resources of the signal processing apparatus 3.

Figure 1:
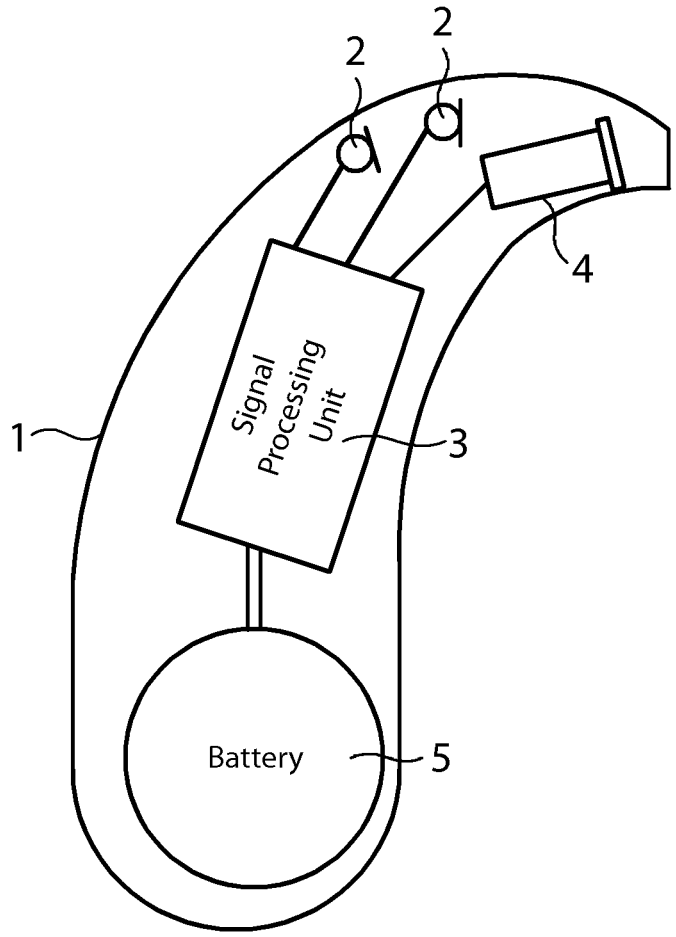
FIG 1 PRIOR ART
FIG. 1 is a schematic layout of a hearing apparatus according to the prior art.
Figure 2:
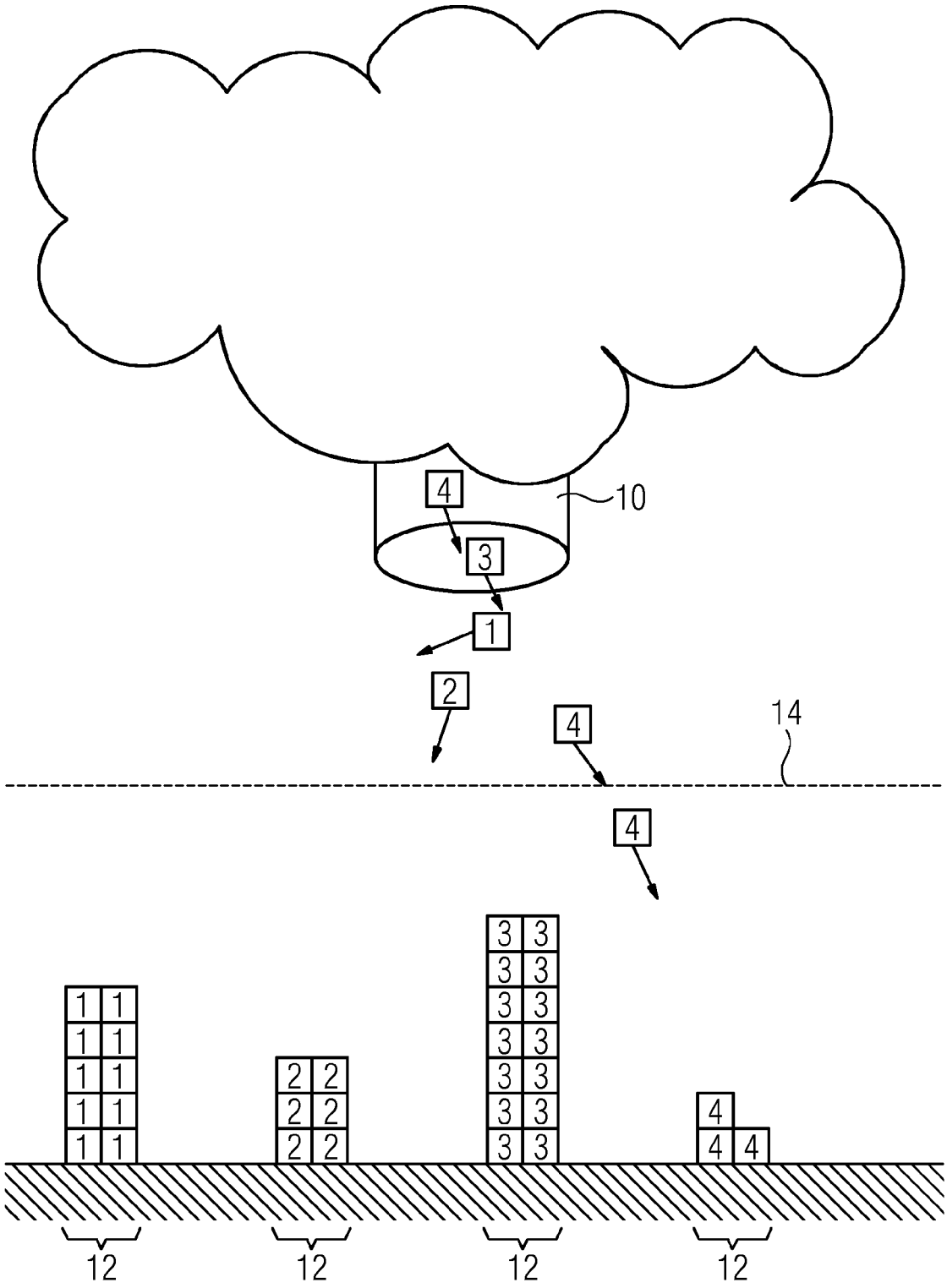
FIG. 2 is a schematic representation of a course of an exemplary embodiment of a method according to the invention.

A significantly lower storage usage can be achieved by the exemplary embodiment of an inventive method illustrated schematically in FIG. 2.

Input data 10 for a smoothing filter is herewith classified in accordance with its association with a plurality of classes 12. If an input value 10 falls into one of the classes 12, a counter associated with the class 12 is incremented. If one of the counters exceeds a predetermined threshold value 14, an output value assigned to the class 12 associated with the counter is thus output as an output value of the filter and all counters are reset to zero. On the other hand, the previous output value is retained.

The signal processing unit 3 must therefore only provide storage space for the counters of the classes 12. The storage space requirement is in this way independent of a window width which is determined by the choice of the threshold value 14. At the same time, the algorithm is robust against outliers and thus enables a reliable smoothing of already discretized input values 10.

If real-valued, non-discrete input variables are to be smoothed, the method shown schematically in FIG. 2 can be refined. A discretization is firstly implemented here for a sequence y0, y1, . . . , yi of input values. Each yi is assigned here to an interval j with the center point bj. A counter vj also exists for each interval j, the counter being initialized at the start of the method to a starting value, preferably zero.

For each new input value yi obtained by the filter, all counters vj are firstly scaled with $0 \leq \lambda \leq 1$ by multiplication with a factor $\lambda$. This limits the growth of the counter values so that here the counter vj does not have to be set to zero at predetermined intervals. Furthermore, the scaling determines how significantly input values yi processed in the past influence the present output values of the filter. The average service life of the counter values amounts on account of the scaling to $\lambda-1$, which can be taken into consideration as a window width of the filter.

After the scaling, the counters vj are modified as a function of the current input value yi. This takes place according to the function $vj \rightarrow \lambda vj+(1-\lambda)\max(0;1-(|yi-bj|)/\sigma)$. Here $\sigma$ represents an influence radius.

For a given input value yi, all counters vj, which are assigned to an interval j, the center point bj of which lies less than a from the input value yi, are therefore increased proportionally with respect to the distance between yi and bj. This results in an additional smoothing of the filter output and improves the robustness of the filter.

After increasing the counter vj, the greatest counter value vj is finally determined and the center point bj of the interval j assigned to this counter vj is output as an output value of the filter. The next input value yi can consequently be processed.

The described method indicates a smoothing behavior, which is very similar to that of the exponentially smoothing means. With greater robustness compared with outliers, significantly less storage space is nevertheless required.

It is further possible to use negative values as output values of the counters vj, and to only then change the output value of the filter if one of the counters vj reaches or exceeds zero. It can herewith be ensured that no change in the output value across predeterminable time segments takes place in order to achieve a particularly smooth output.

The invention claimed is:

1. A method for operating a hearing apparatus, which comprises the steps of:

determining an operating parameter of the hearing apparatus;

smoothing the operating parameter via a filter, the smoothing includes the following steps:

a) for each input value of the operating parameter, classifying the input value in accordance with an association with a plurality of predetermined classes and increasing a counter assigned to a respective class associated with the input value, wherein each of the predetermined classes is respectively a cohesive interval across a predetermined non-discrete value range;

a1) increasing all counter values by an amount dependent on a distance of the input value from a center point of the cohesive interval corresponding to the respective class;

b) determining the counter with a greatest counter value; and c) outputting an operating parameter value assigned to the counter with the greatest counter value as an output variable of the filter.

2. The method according to claim 1, wherein in the step c), outputting the operating parameter value assigned to the counter with the greatest counter value as the output variable only if the greatest counter value exceeds a predetermined threshold value and that otherwise the operating parameter value output last is retained as the output variable.

3. The method according to claim 2, wherein when the predetermined threshold value is exceeded by one counter value in step c), all counter values are set to zero after outputting the output variable.

4. The method according to claim 1, wherein prior to increasing a counter value in step a), scaling all the counter values with a predetermined factor $\lambda$ where $0 \leq \lambda \leq 1$.

5. The method according to claim 4, which further comprises increasing a counter vj of a class j of the predetermined classes, to which is assigned the interval with the center point bj, is increased by $(1-\lambda)\max(0,1-(|yi-bj|/\sigma))$ for each said input value yi of the operating parameter, wherein $\sigma$ represents a predetermined influence radius.

* * * * *